US010018963B2

(12) United States Patent
Tschumi et al.

(10) Patent No.: US 10,018,963 B2
(45) Date of Patent: Jul. 10, 2018

(54) CONTROL SYSTEM FOR A TIMEPIECE

(71) Applicant: The Swatch Group Management Services AG, Biel/Bienne (CH)

(72) Inventors: Philipp Tschumi, Niederwil (CH); Sebastien Briswalter, Pfetterhouse (FR)

(73) Assignee: The Swatch Group Management Services AG, Biel/Bienne (CH)

( * ) Notice: Subject to any disclaimer, the term of this patent is extended or adjusted under 35 U.S.C. 154(b) by 0 days.

(21) Appl. No.: 15/128,233

(22) PCT Filed: Mar. 6, 2015

(86) PCT No.: PCT/EP2015/054744
§ 371 (c)(1),
(2) Date: Sep. 22, 2016

(87) PCT Pub. No.: WO2015/144423
PCT Pub. Date: Oct. 1, 2015

(65) Prior Publication Data

US 2017/0123377 A1 May 4, 2017

(30) Foreign Application Priority Data

Mar. 26, 2014 (EP) ..... 14161801

(51) Int. Cl.
*G04B 3/04* (2006.01)
*G04B 11/00* (2006.01)
(Continued)

(52) U.S. Cl.
CPC ..... *G04B 13/027* (2013.01); *G04B 3/041* (2013.01); *G04B 11/003* (2013.01); *G04B 13/021* (2013.01); *G04B 27/02* (2013.01)

(58) Field of Classification Search
CPC ..... G04B 3/041; G04B 27/02; G04B 27/04; G04B 13/00; G04B 13/02; G04B 13/021;
(Continued)

(56) References Cited

U.S. PATENT DOCUMENTS 2,587,277 A * 2/1952 Bergman ..... G04B 19/21 368/185
2,814,188 A * 11/1957 Fox ..... G04B 11/003 29/453

(Continued)

FOREIGN PATENT DOCUMENTS

CH 691 199 A5 5/2001
CH 705 862 A2 6/2013

(Continued)

OTHER PUBLICATIONS

English translation of JP2010-139399, retrieved from the internet Nov. 25, 2017.*

(Continued)

*Primary Examiner* — Vit W Miska
(74) *Attorney, Agent, or Firm* — Oblon, McClelland, Maier & Neustadt, L.L.P.

(57) ABSTRACT

A control system for a rotating element of a timepiece including a control element for actuating the rotating element and a transmission device between the control element and the rotating element. In the control system a gearing device includes a hybrid gearing device including a first element, which is movable around a first rotation axis and including a drive runner made from elastomeric material, and a second element, which is movable around a second rotation axis and including a rolling tooth system. The drive runner cooperates with the rolling tooth system by friction.

6 Claims, 4 Drawing Sheets

(51) Int. Cl.
*G04B 13/02* (2006.01)
*G04B 27/02* (2006.01)

(58) Field of Classification Search
CPC ... G04B 13/025; G04B 13/026; G04B 13/027
See application file for complete search history.

(56) References Cited

U.S. PATENT DOCUMENTS

| | | | | |
|---|---|---|---|---|
| 3,177,648 | A * | 4/1965 | Boyles | G04B 18/028 368/186 |
| 3,443,375 | A * | 5/1969 | Cielaszyk | G04B 11/003 368/185 |
| 3,548,587 | A * | 12/1970 | Wood | G04B 11/003 368/191 |
| 3,548,588 | A | 12/1970 | Piquerez | |
| 3,930,362 | A * | 1/1976 | Cielaszyk | G04B 19/02 368/185 |
| 4,845,693 | A * | 7/1989 | Kubota | G04B 19/25 368/185 |
| 4,932,011 | A * | 6/1990 | Schwartz | G04B 27/04 368/185 |
| 6,179,464 | B1 | 1/2001 | Bettelini | |
| 7,192,182 | B2 * | 3/2007 | Hiranuma | G04B 37/103 368/288 |
| 7,712,953 | B2 * | 5/2010 | Scheufele | G04B 11/008 368/101 |
| 9,348,312 | B2 * | 5/2016 | Gruenig | G04B 15/08 |
| 2011/0235474 | A1 * | 9/2011 | Wiederrecht | G04B 1/225 368/200 |

FOREIGN PATENT DOCUMENTS

| | | | |
|---|---|---|---|
| DE | 35 44 743 | A1 | 6/1987 |
| FR | 1027587 | | 5/1953 |
| FR | 1600860 | | 8/1970 |
| GB | 1092848 | | 11/1967 |
| JP | 2010-139399 | * | 6/2010 |

OTHER PUBLICATIONS

International Search Report dated Jun. 5, 2015 in PCT/EP15/054744 Filed Mar. 6, 2015.

* cited by examiner

CONTROL SYSTEM FOR A TIMEPIECE

The present invention relates to a control system for a rotating element of a timepiece and more particularly for a flange.

Flanges, which consist of an annular piece arranged on the periphery of a dial and which partially cover the edge of the latter, have long been known in the field of clockmaking. They can be fixed or not to a bezel, to which the glass of the watch is fitted. Some flanges are movable in rotation independently of the bezel and located integrally under the glass. To control such rotating flanges, the most usual control system consists of using a crown provided with an end pinion at its end, which meshes with a serration arranged on an inside face of the flange to drive the latter in rotation. Patent FR 1027587, for example, describes such a control system via the cooperation of toothing arrangements of the flange and of a crown pinion where meshing is only possible in a pulled-out working position of the crown, and a spring-mounted pin acts as an indexing element for the angular positions of the flange.

A disadvantage of this type of control system is that it requires a relatively deep toothing arrangement to ensure that the toothing of the end pinion of the crown and the serration of the flange interlock. Consequently, the vertical space is quite significant and increases the size of the case enabling such a system to be accommodated and ensuring transmission between the rotation of the crown and that of the flange. Moreover, the mutual cooperation of the two toothing arrangements involved in the gearing mechanism makes this transmission system quite noisy and also relatively inconvenient for fine adjustments. In fact, the angular indexing of the flange following actuation of the crown is dependent on the number of teeth of the end pinion of the latter, the diameter of which is generally markedly smaller than that of the flange. It is actually difficult to machine a large number of teeth on a piece of small dimension, and the number of teeth of this piece influences the gear ratios considerably, i.e. the gear reduction of the angular course of the flange in relation to that of the crown.

Friction drive mechanisms are additionally known for the gearing of other types of timepieces, in particular those of low cost. For example, document CH 691199 discloses a control crown that, in a predefined working position, is arranged to set in rotation a rod provided with an end knob devoid of teeth that cooperates by friction with a peripheral bead of a dial train wheel and subsequently the entire dial train during a time reset.

The disadvantage of this type of gearing is that it has a lower degree of accuracy and lower transmission efficiency in rotation, in particular over time because of the progressive wear of the contact surfaces of the gearing pieces. This deterioration of the surfaces results in a decrease in the intensity of the friction forces and eventually causes substantial mutual sliding rather than a rolling transmission between the gearing pieces.

An aim of the present invention is therefore to propose an alternative solution for a control system of a flange in particular, and more generally of a rotating element for a timepiece, that does not have these known limitations.

For this, the invention relates to a control system for a rotating element of a timepiece comprising a control element for actuating said rotating element and a transmission device between said control element and said rotating element. The control system is characterised in that the transmission device is a hybrid gearing device comprising a first element which is movable around a first rotation axis and provided with a drive runner made from elastomeric material, and a second element which is movable around a second rotation axis and provided with a rolling tooth system, wherein the drive runner cooperates with the rolling tooth system by friction.

The invention also relates to each element of the timepiece control system forming a part of the transmission device separately, i.e.:

- a control element of a timepiece, characterised in that it comprises a first element movable around a first rotation axis, on which a drive runner made from elastomeric material is mounted; and
- a rotating element of a timepiece movable around a second rotation axis, characterised in that it comprises a second movable element having a rolling tooth system.

A first advantage of the proposed solution is to provide a significant gain in vertical space because of the flattened profile of the rolling surface of the driving gear wheel or the driven gear wheel of the described hybrid gearing device without, however, reducing the quality of the transmission or its reliability over time.

Another advantage of the proposed solution is that it results in a quiet gearing mechanism because the drive runner is made from elastomeric material, the suppleness of which preventing every jolt and gearing clicking noise, in contrast to the mutual cooperation of toothing systems of the driving and driven gear wheels of a solution known from the prior art.

A further advantage of the proposed solution is that it allows a reduction in costs as a result of the saving both of the complex machining of a tooth system of a gear wheel of small dimension, like typically a drive pinion, and a saving in material because of the flattening of the drive notches, typically on a driven gear wheel of larger diameter.

An additional advantage of the proposed solution is that it facilitates the positioning of the control element and the rotating element in relation to one another, in particular in a case, since the elastic properties of the drive runner made from elastomeric material enable the positioning clearances to be recovered for the respective axes of the driving and driven wheel elements involved in the proposed gearing device.

Other features and advantages of the present invention will become clear from the following description of a preferred embodiment relating to a flange driven by a control crown provided as a non-restrictive example with reference to the attached drawings, wherein:

FIGS. 1A, 1B and 1C respectively show a top view, a sectional view and a three-dimensional view of a middle part provided to accommodate the control system for a rotating flange according to a preferred embodiment of the invention;

FIGS. 2A, 2B and 2C respectively show a top view, a sectional view and a three-dimensional view of a rotating flange according to a preferred embodiment of the invention;

FIGS. 3A, 3B and 3C respectively show a profile view, a sectional view and a three-dimensional view of a control crown according to a preferred embodiment of the invention;

The preferred embodiment illustrated by all the following figures represents a flange used as rotating element as well as a crown used as control element. However, the person skilled in the art will understand that the invention applies to other types of rotating elements that do not necessarily form part of display elements, but can consist of transmission or gear elements of a timepiece wheel train. Moreover, the invention also relates to control elements that do not necessarily consist of a crown. Thus, as an example of an alternative embodiment that is not shown, it could also be conceivable to use, in place of the crown as control element, a button acting on the toothing of a gear wheel by means of a control rod, and to arrange the drive runner on a coaxial and rotationally fixed gear wheel of the toothed wheel driven by the rod. However, this embodiment has the disadvantage of not being able to perform the control of rotation equally in both directions.

In standard clockmaking terminology a runner is a piece traditionally formed by a steel roller that serves to substitute rolling friction for sliding friction (see Illustrated Professional Dictionary of Horology of G-A. Berner, p. 518, reference 2221). Therefore, within the framework of the present application, a drive runner will be referred to, by extension, for a piece whose purpose it is to transmit a rotation movement by rolling friction with another movable piece.

Figure 1A:
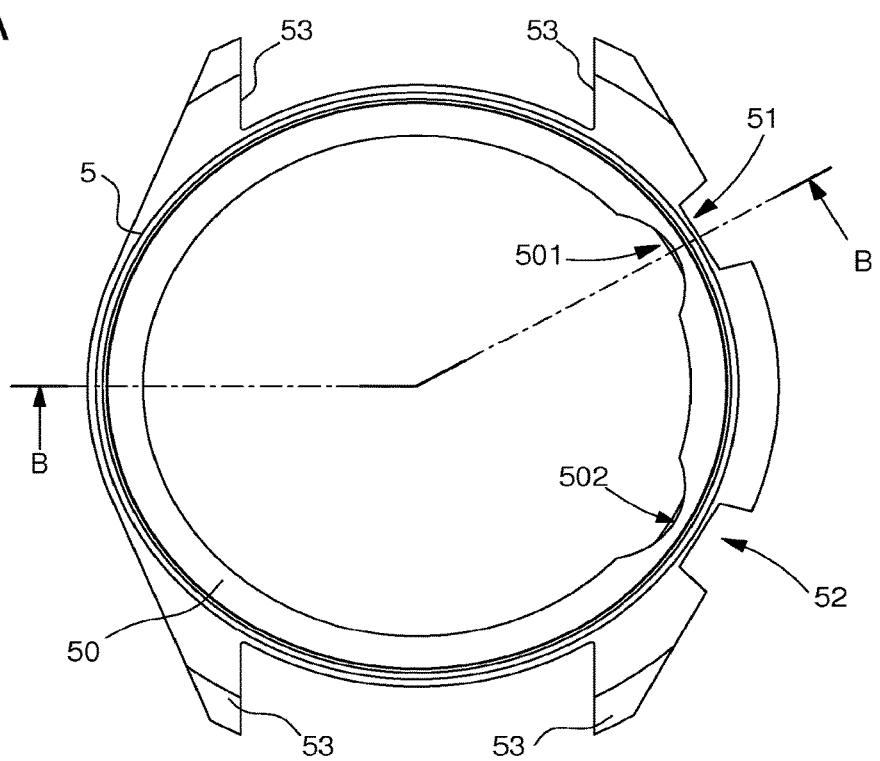
Figure 1B:
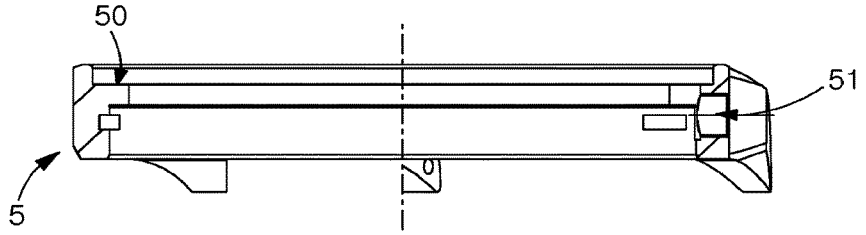
Figure 1C:
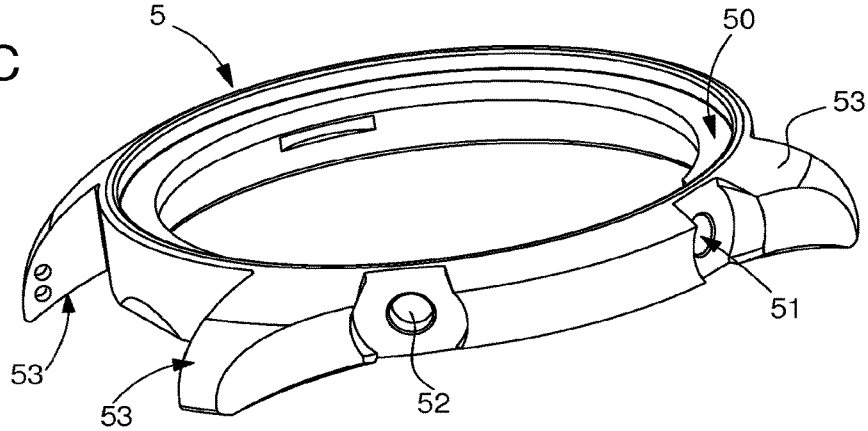

FIGS. 1A, 1B and 1C respectively show a top view, a sectional view and a three-dimensional view of a middle part 5 provided to receive the control system according to the invention formed by a crown 1 and a flange 3 illustrated in the following FIGS. 2A,B,C and 3A,B,C. The middle part 5 comprises two pairs of attachment horns 53 for a watch band and also a shoulder 50 forming a supporting surface for the rotating flange 3. The middle part is pierced by a first threaded through hole 51 and also a second threaded through hole 52, preferably for the assembly of crown tubes. A first hollow 501 and a second hollow 520, visible in FIG. 1A, are respectively arranged at the level of each of these threaded holes. These hollows allow passage of a key for assembling or changing various component elements of the crown 1 assembled on the middle part 5 during after-sales service, and in particular the drive runner 25 on its axis.

FIG. 1B shows a sectional view of the middle part 5 taken along the first sectional axis B-B of FIG. 1A passing through the first threaded through hole 51, in which the thickness of the shoulder 50 can be seen, whereas in FIG. 1C the same elements may be seen as in FIG. 1A, except for the first and second hollows 501, 502.

Figure 2A:
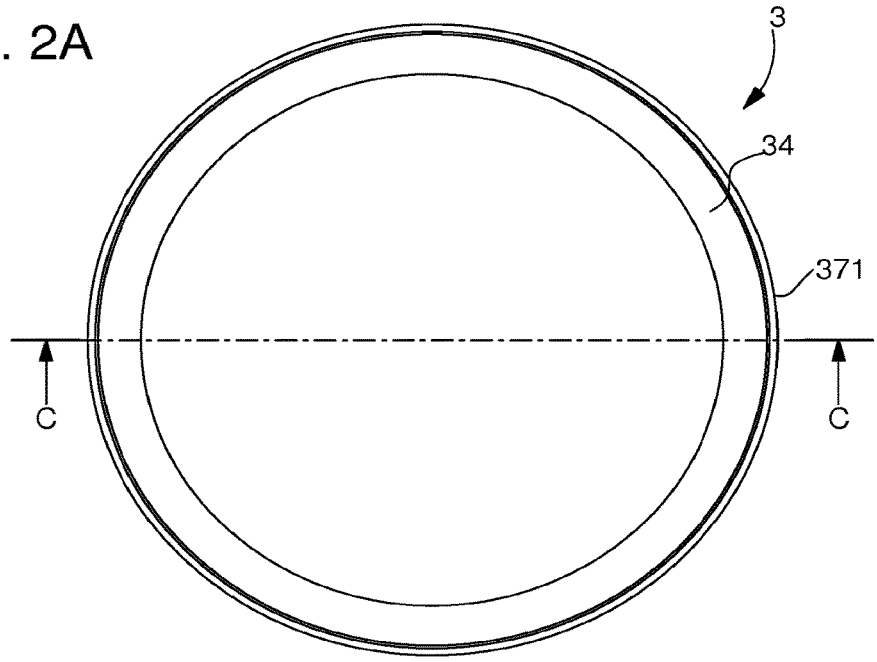
Figure 2B:
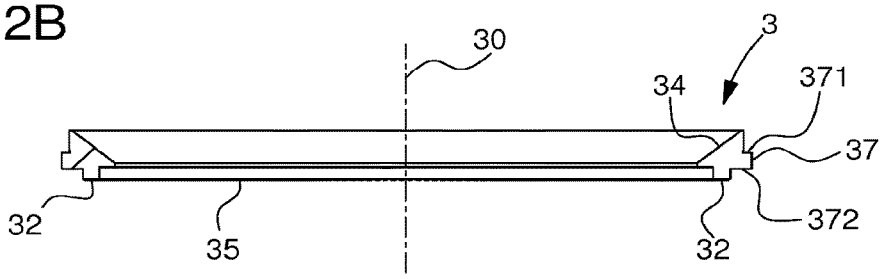
Figure 2C:
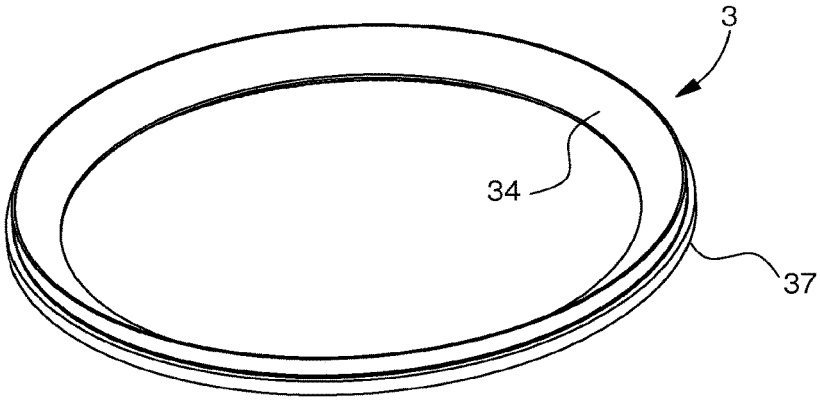

FIG. 2A shows a top view of the flange 3 intended to be mounted on the middle part 5 of the preceding FIGS. 1A, 1B and 1C, in which its upper face can be seen that consists of an oblique display surface 34, without display elements here, but which can be seen subsequently in FIG. 4, as well as the upper surface 371 of a peripheral rim 37 intended to provide a supporting surface for an annular element arranged on its periphery. FIG. 2B shows the flange 3 taken along the second sectional axis C-C of FIG. 2A with the peripheral rim 37 clearly evident, and the upper surface 371 as well as the lower surface 372 thereof, the oblique display surface 34, but above all the rolling tooth system 32, which cooperates with the drive runner 25, which is visible in the following FIGS. 3A, 3B and 3C, of the crown. This rolling tooth system 32 that serves to transmit the rotation movement of the crown 1 when the latter is actuated by the user of the watch, extends along an annular lower face of the flange 3, and it can be seen that this rolling tooth system 32 is located in a meshing plane 35 perpendicular to the second rotation axis 30 of the flange 3. This rolling tooth system 32 is preferably formed by a flat toothing, as illustrated in FIG. 5, but as an alternative it is conceivable to use another type of rolling surface such as a knurled section or even a material that is sufficiently rough to guarantee the transmission of the rolling of the drive runner 25 while avoiding all sliding. FIG. 2C illustrates the same component elements of the flange 3 as FIG. 2A described above, i.e. the oblique display surface 34 as well as the peripheral rim 37 and its upper surface 371.

Figure 3A:
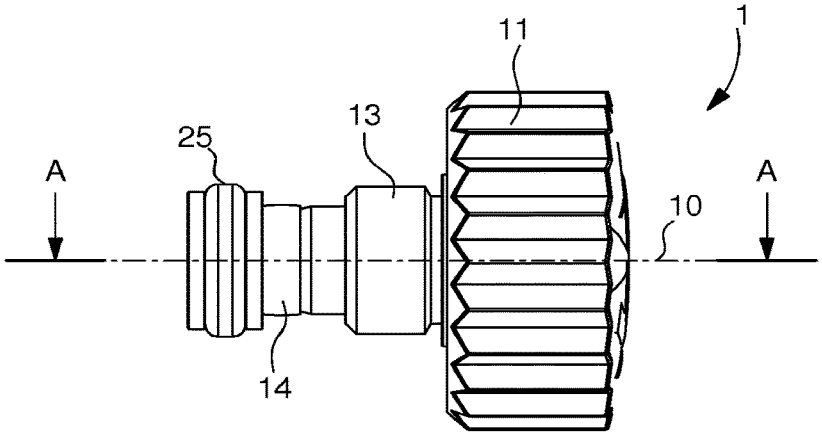

FIG. 3A shows a profile view of a crown 1 according to a preferred embodiment of the invention. Although this is a crown that is not screwed down and only has a single axial position in relation to the middle part, it will be understood that the hybrid gearing system as well as the arrangement of a drive runner 25 on a crown is not dependent on the structure of crown used, and that thus a screwed down crown could certainly also be used without departing from the framework of the invention or setting structural limits on the proposed hybrid gearing mechanism between the drive runner 25 and the rolling tooth system 32 of the flange 3, or any other movable element to be driven.

The crown 1, which is movable around a first rotation axis 10, is classically composed of a tube 13, which is intended to be mounted on the middle part 5 by pressing or screwing in place and above which is arranged a cover 11 that can be operated by the user of the watch. The drive runner 25 in the form of a first O-ring type sealing ring or a moulded-on seal is arranged at the level of the proximal end of the crown, on the left in FIGS. 3A, 3B and 3C. The advantage of using an O-ring type seal is that the drive runner 25 can be used as an wear part that is replaceable independently of the rest of the crown 1. The drive runner 25 is made from an elastomeric material precisely for the purpose of increasing the friction forces and improving the quality of the transmission of the rolling in the manner of a tyre of a vehicle on the surface of a road. A friction ring 14, which is in the form of a second seal that is preferably rectangular in section in order to maximise the friction surface with each of the pieces, is preferably arranged between the rotationally fixed transmission element of the crown 1, on which the drive runner 25 is arranged, and the tube 13. The friction surfaces are thus configured in an annular shape in each of the friction planes. However, an O-ring type of sealing ring or also another moulded-on seal could also be envisaged, but this would require a more significant axial compression of the seal to guarantee the same friction forces. This friction ring 14 serves to increase the torque of the flange 3 and thus eliminate parasitic and involuntary movements of the flange 3 during handling of the crown 1. Although the crown 1 is not a screwed down crown in the illustrated preferred embodiment, such a friction ring 14 is particularly advantageous for a screwed down crown that has several axial positions, in particular during transition from a locked or screwed down position "T0" to a pulled or non-screwed down position "T1" of adjustment. In fact, in the frame of a dive watch, for example, the advantage of a screwed down crown would be to block the rotation of the flange 3 by screwing it down as required in order to prevent any accidental displacement. This proves indispensable for safety reasons, since it must not be possible to modify in any event the critical time indications for a dive such as the time remaining before going into a decompression stage, for example. At the same time as the locking in position by screwing down, the friction ring 14 remains indispensable in this case to prevent any accidental rotation of the flange 3 precisely during unscrewing operations and above all when screwing down the crown 1 again.

Figure 3B:
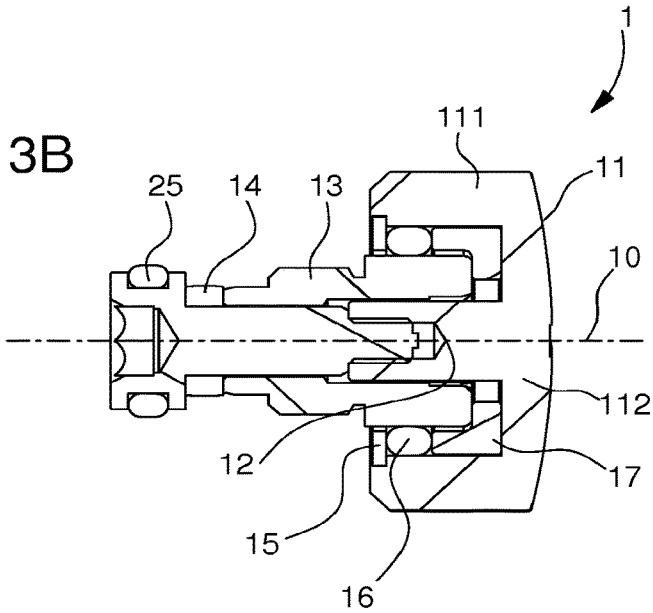
Figure 3C:
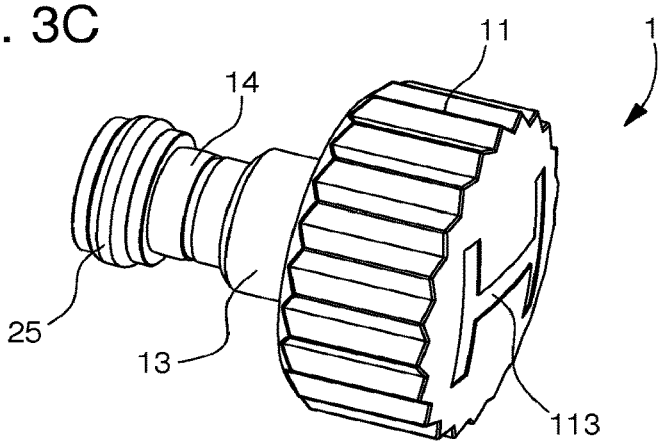

FIG. 3B shows a sectional view along the third cross-sectional axis A-A of FIG. 3A showing, in addition to other elements already described in FIG. 3A, a central threaded cylinder 12 to be connected to a control rod, and also the axial skirt 111 and the cap 112 of the cover 11. Additionally visible are also the sealing elements of the crown head in relation to the interior of the middle part, i.e. a third seal 16 also toric in shape covered by a deck ring 15. Moreover, the third ring seal 16 is held axially in place by means of a cross member 17. In FIG. 3C the illustrated elements of the crown 1 are similar to those already described in relation to FIG. 3A, i.e. the drive runner 25, the friction ring 14 and the tube 13. However, a logo "H" can be seen on the outside face 113 of the cover 11, and the knurled section over the periphery of the axial skirt 111 of the cover 11, which is provided to facilitate gripping and handling of the crown by the user, is more clearly visible.

Figure 4:
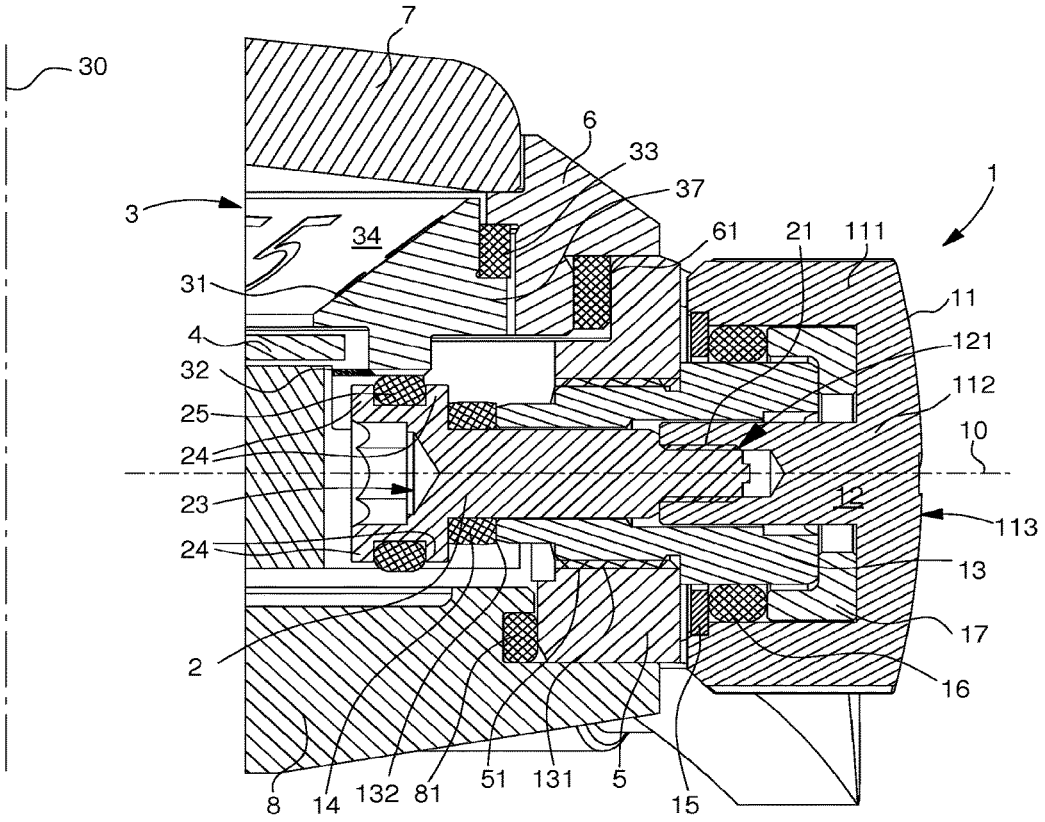
FIG. 4 is a sectional view of the control system for a rotating flange according to a preferred embodiment of the invention integrated into a wrist watch.
Figure 5:
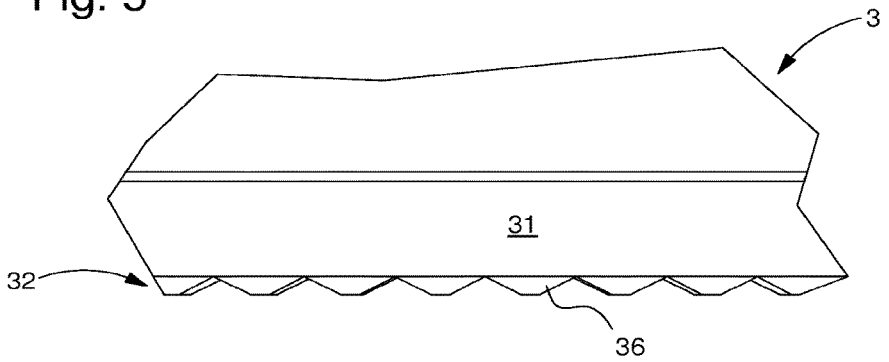
FIG. 5 is a detail view of the rolling surface used for the flange according to the preferred embodiment of FIGS. 2A, 2B and 2C.

FIG. 4 shows a sectional view of the detail of the control mechanism according to the preferred embodiment of the invention where the flange 3 and the control crown 1 illustrated separately in the preceding FIGS. 2 and 3 are now integrated into the middle part 5 of a watch.

According to the invention the proposed hybrid gearing device of the control system for a rotating element concerns the transmission of a rotation movement between a first movable element and a second movable element around their respective rotation axis by means of gearing by rolling friction between the two movable pieces, one being fitted over its periphery with a preferably smooth elastomeric material and the other with a harder material such as metal or steel, for example, and preferably having a tooth arrangement. The gearing used within the framework of the present invention is thus described as "hybrid" not only for this first reason of potential inadequacy between the two materials responsible for the transmission, but also because it is possible to cause cooperation between surfaces of a different nature such as a serration, a knurled section and/or also a rough surface with a smoother surface such as that of the drive runner 25. The cooperation of elements of different nature, i.e. in which the materials and surface profiles are heterogeneous, is unusual for a traditional gear transmission mechanism in clockmaking where generally the metal tooth system of a first gear wheel is provided to cooperate with another metal tooth system of another gear wheel. Alternatively, in the context of friction gearing no toothing is ever used as rolling surface.

According to the preferred embodiment described where the rotating element is a flange 3 and the control element is a crown 1, the second movable element 31 can be considered as the body of the flange 3 referenced in FIG. 4, whereas here the flange 3 additionally comprises a washer 33 made from Teflon arranged above its peripheral rim 37. This washer 33 made from Teflon rests against the upper surface 371 thereof in order to minimise the friction with the bezel 6. The first movable element, which is rotationally fixed to the drive runner 25, is formed here by the central pipe 2 of the crown 1, which is also rotationally fixed to the cover 11 of the crown 1 following the screwing into place of its threaded upper part 21 in the threaded blind hole 121 of the central cylinder 12.

According to the described preferred embodiment it may be noted that the drive runner 25 is arranged on a driving element, i.e. the rotationally fixed central pipe 2 of the crown 1, whereas the rolling tooth system 32 is arranged on a driven element, i.e. the second movable element 31 of the flange 3. Such an arrangement of the drive runner 25 made from elastomeric material on the driving element is advantageous for improving the efficiency of the transmission as well as reducing production costs, in particular when the circumference thereof, which in this case is adjacent to that of its lower part 23 and is threaded for possible fastening to a control rod, is clearly smaller than the circumference of the driven element, such as the flange 3, and this allows a saving in elastomeric material and additionally simplifies the machining of the movable element 31 as well as the central pipe 2. Moreover, while the gearing is achieved by mutual rolling friction, it may be noted that the ratio of the circumference of the driving element in relation to that of the driven element allows a continuous gear ratio to be defined, in contrast to a ratio of the number of teeth of a driving gear to the number of teeth of a driven gear, which is dependent on discrete values. At the same time, there is no necessity for traditional pointed and deep teeth and thus any indexing jolt is avoided. Moreover, highly precise positioning of the rotation axes of the parts in relation to one another, also often referred to as "centre distance of axes", is rendered unnecessary by the proposed solution, wherein these positioning clearances can be recovered because of the plastic properties of the elastomeric drive runner 25, which will then be compressed to greater or lesser extent against the rolling surface of the gear to be driven in rotation. The assembly of the control device is thus simplified and this permits additional productivity gains.

In FIG. 4 the control crown 1 is a crown that only has a single axial position in relation to the middle part, which has a cover 11 projecting outside the middle 5 and which can be caused to rotate by the user of the watch. However, as part of the invention it would also be possible to use a screwed down crown without this affecting the proposed particular transmission device. The cover 11 is mounted above a tube 13, which is provided here with a thread 131 for its assembly by screw connection to the middle part 5 in the first threaded through hole 51, into which a central cylinder 12 fixed to the cover 11 is inserted, and is provided at its end with a threaded blind hole 121 for assembly on a central tube 2 that itself has a threaded upper part 21. The central pipe 2 thus forms a first movable element of the control element forming part of the crown 1; it is movable in rotation in relation to the tube 13 screwed to the middle part 5, and it is at the level of its proximal end, i.e. the threaded lower part 23 for the possible addition of a control rod not shown that the drive runner 25 made from elastomeric material is arranged as replacement of an end pinion, as in traditional crowns. The drive runner 25 formed here by a first ring seal, which is arranged in a groove delimited by two axial abutments 24 arranged in a plane perpendicular to the first rotation axis 10 of the crown, which is also that of the central pipe 2, and said abutments can be in one piece with the central pipe 2 or consist of washers mounted on this.

According to the preferred embodiment illustrated in FIG. 4, it is evident that a second seal that is preferably rectangular or square in cross-section is arranged around the central pipe 2 and rests against a shoulder 22. This second seal forms the friction ring 14 that is already visible in the previously described FIGS. 3A, 3B and 3C, and this is arranged between the central pipe 2 and the tube 13 screwed to the middle part 5 in order to increase the actuation torque of the crown 1 and thus prevent any parasitic movement from being imposed on the flange 3. Here the friction ring 14 is held axially in place between the shoulder 22 of the central pipe 2, which can also be formed by a washer, and even possibly the other face of the washer used as axial abutment 24 for the drive runner 25, and the lower end 132 of the tube 13 screwed to the middle part 5. Lightly compressed between the lower end 132 of the tube 13, which is fixed in relation to the middle part, and the rotationally fixed shoulder 22 of the central pipe 2, this friction ring thus enables the setting in rotation of the crown 1 to be rendered more difficult, and thus secures the angular position of the flange 3 more effectively. According to the described preferred embodiment, it could be seen that this friction ring 14 is interposed between the tube 13 and a part of the central pipe 2, here the shoulder 22, such that the friction is arranged in planes perpendicular to the first rotation axis 10 of the crown 1. This type of friction could be described as axial friction. According to a variant, however, it is possible to envisage arranging such a friction ring 14 directly inside the tube 13 of the crown in a groove disposed directly on the central pipe 2 such that the friction is no longer axial, but radial. The advantage of using an axial friction ring 14 such as that shown in FIG. 4 is that it is possible to dispense with substantial wall thicknesses to enable a sufficiently deep groove to be arranged therein and the friction element to be accommodated therein. It is thus compatible with crown tubes that have end parts of reduced diameter and a thin wall below the threaded part for assembly on the middle part, such as that of the shown tube 13, and this enables in particular a casing circle of the movement to be centred as required.

The part of the crown 1 that projects out of the middle part 5 is shown in an enlarged view of the detail of the elements illustrated in FIG. 3B, i.e. a central threaded cylinder 12 connected to the central pipe 2, the axial skirt 111 and the cap 112 of the cover as well as the sealing elements of the crown head in relation to the inside of the middle part, i.e. a third ring seal 16 covered by a deck ring 15 and, moreover, held axially in place by means of a cross member 17. However, these elements have no influence on the hybrid gearing mechanism proposed within the framework of the present invention and in particular on the arrangement of the drive runner 25.

As can be seen from FIG. 4, the drive runner 25 made from elastomeric material cooperates with a rolling tooth system 32 arranged on the inside face of a flange body 3, which constitutes a preferred embodiment of a rotating element within the framework of the invention. The flange 3 is composed of a second movable element 31, i.e. the body of the flange, on which the rolling tooth system 32 is arranged, partially covering the edge of the dial 4, and which is provided with an annular peripheral rim 37, on which a washer 33 made from Teflon is mounted in order to minimise the friction with the bezel 6, which is, moreover, covered by the glass 7 and latched onto the middle part 5. To guarantee the seal to the inside of the middle part, a seal formed by a fourth ring seal 61 is arranged between the bezel 6 and the middle part 5, and similarly a fifth ring seal 81 is interposed between the base 8 and the middle part 5.

According to the illustrated preferred embodiment applied to the driving in rotation of a flange 3 by a crown, the rolling tooth system 32 extends essentially in a meshing plane parallel to the first rotation axis 10 of the crown 1, i.e. perpendicularly to the second rotation axis 30 of the flange 3. Consequently, the hybrid gearing mechanism serves as gear without requiring the use of inclined tooth systems to gain vertical space. However, it will be understood that it would be possible to arrange a hybrid gearing device according to the invention comprising an oblique rolling tooth system 32, in particular inclined 45 degrees in relation to the rotation axis of the driven or driving gear wheel, to achieve a 90 degree gear, or also to arrange a rolling tooth system 32 that no longer extends in a plane, but in a cylindrical portion on the periphery of a gear wheel cooperating with a gear wheel rotating along a parallel axis in order to assure the transmission in rotation to a second gear wheel rotating along a parallel rotation axis.

FIG. 5 shows the detail of a rolling tooth system 32 according to a preferred embodiment where it is arranged on the lower face of the second gear wheel 31 of the flange and extends along an annular surface located in a plane perpendicular to the second rotation axis 30, i.e. the meshing plane 35 referenced in FIG. 3B. The rolling tooth system 32 is formed here by a flat tooth system 36, the toothing profile of which is greater than 90 degrees and preferably between 100 and 130 degrees, and 120 degrees here in FIG. 5. Such a profile would not be suitable for an intermeshing of toothing on adjacent gear wheels because of the risk of sliding, but is perfectly suitable here for limiting the space requirement and guaranteeing the transmission of the rotation by rolling of the drive runner 25 made from elastomeric material lightly compressed in the hollows of this flat tooth system 36. As an alternative, it would be possible to use a knurled section formed, for example, by oblique lines extending in a single direction or in two symmetrically opposed directions, wherein the difference from the flat tooth system corresponds to a less significant depth of the impressions formed on the rolling tooth system 32, thus allowing a slight gain in additional height. It is also possible to replace the flat toothing system 36 or knurled section with a very rough plane surface in order to allow the transmission of the rolling without any risk of sliding; nevertheless, such an alternative would pose the risk of the drive runner 25 wearing rapidly by tearing of the elastomeric material because of the highly abrasive nature that would be necessary to guarantee the quality of the transmission and thus require its frequent replacement. In any case, if a flat tooth system 36 is used or a knurled section, the depth of the tooth systems or the impressions will preferably not exceed a quarter of a millimeter (i.e. 0.25 mm) and according to the described preferred embodiment this depth is preferably in the range of between 0.05 and 0.20 mm in order to gain the maximum height possible compared to a classic gearing mechanism.

The invention claimed is:

1. A control system for a rotating element of a timepiece, comprising:

a control element for actuating the rotating element; and a transmission device between the control element and the rotating element, wherein the transmission device comprises a hybrid gearing device comprising a first element, which is movable around a first rotation axis and comprising a drive runner made from elastomeric material, and a second element, which is movable around a second rotation axis and comprising a rolling tooth system, wherein the drive runner cooperates with the rolling tooth system by friction, wherein the first rotation axis of the first movable element is perpendicular to the second rotation axis of the second movable element, and wherein the drive runner cooperates by friction with the rolling tooth system essentially in a meshing plane perpendicular to the second rotation axis of the second movable element.

2. The control system for a rotating element of a timepiece according to claim 1, wherein the rolling tooth system comprises a flat toothing system, a depth of which is in a range of between 0.05 and 0.20 mm.

3. The control system for a rotating element of a timepiece according to claim 1, wherein the drive runner made from elastomeric material comprises a first ring seal.

4. The control system for a rotating element of a timepiece according to claim 1, wherein the rotating element is a flange, and the control element is a crown.

5. The control system for a rotating element of a timepiece according to claim 4, further comprising a friction ring comprising a second seal of rectangular cross-section, which is movable around the first rotation axis of the crown.

6. A control system for a rotating element of a timepiece, comprising:

a crown to actuate a flange; and a transmission device between the crown and the flange;

wherein the transmission device comprises a hybrid gearing device comprising a first element, which is movable around a first rotation axis and comprising a drive runner made from elastomeric material, and a second element, which is movable around a second rotation axis and comprising a rolling tooth system including a plurality of flat teeth, and wherein the drive runner cooperates with the flat teeth by friction.

* * * * *